US006742503B2

(12) United States Patent
Feucht

(10) Patent No.: US 6,742,503 B2
(45) Date of Patent: Jun. 1, 2004

(54) DUAL PRESSURE FLUID SYSTEM AND METHOD OF USE

(75) Inventor: Dennis D. Feucht, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 71 days.

(21) Appl. No.: 10/245,349

(22) Filed: Sep. 18, 2002

(65) Prior Publication Data

US 2004/0050369 A1 Mar. 18, 2004

(51) Int. Cl.[7] ..... F02M 33/04

(52) U.S. Cl. ..... 123/446; 137/625.69; 236/93 A; 123/464

(58) Field of Search ..... 123/446, 447, 123/464; 251/11; 236/92 R, 92 A, 93 A; 137/625.69, 625.4

(56) References Cited

U.S. PATENT DOCUMENTS 2,400,615 A * 5/1946 Warrick et al.
3,659,567 A * 5/1972 Murray ..... 123/41.12
3,927,830 A * 12/1975 Briski ..... 236/100
4,190,198 A * 2/1980 Casuga et al. ..... 236/34.5
4,312,379 A * 1/1982 Kinder ..... 137/625.48
4,488,680 A * 12/1984 Itoh ..... 236/93 A
5,121,730 A 6/1992 Ausman et al.
5,617,724 A 4/1997 Ko
5,813,309 A 9/1998 Taka et al.
5,911,212 A 6/1999 Benson
6,003,313 A 12/1999 Farrar

* cited by examiner

*Primary Examiner*—Thomas N. Moulis
(74) *Attorney, Agent, or Firm*—Finnegan, Henderson, Farabow, Garrett & Dunner

(57) ABSTRACT

A fluid system for supplying low and high pressure fluid is provided. A first pump discharges a first pump flow. A filter receives a first portion of the first pump flow and discharges a filter flow. A first accumulator receives a first portion of the filter flow. A valve receives a second portion of the first pump flow and a second portion of the filter flow, and discharges a valve flow. The valve is movable between a first position, providing a first flow path between the second portion of the first pump flow and the valve flow, and a second position, providing a second flow path between the second portion of the filter flow and the valve flow. A second pump receives the valve flow and discharges a second pump flow. A second accumulator receives the second pump flow.

21 Claims, 3 Drawing Sheets

DUAL PRESSURE FLUID SYSTEM AND METHOD OF USE

TECHNICAL FIELD

This invention relates generally to a fluid system for supplying a low pressure fluid and a high pressure fluid and, more particularly, to a fluid system providing alternative conditional flow paths for supplying the high pressure fluid.

BACKGROUND

In the past, fluid systems in engines have been called upon to both lubricate and cool the engines. Nowadays, fluid systems in engines may be called up to perform several different functions, not only including the traditional functions of lubricating and cooling the engine, but also to provide fluid to actuate other components. These different functions may require fluid to be supplied at different pressures, and thus, present day systems may be called upon to supply both a low pressure fluid to a low pressure accumulator and a high pressure fluid to a high pressure accumulator. The low pressure accumulator may then supply the fluid for lubricating and cooling the engine and engine components, for instance, to a gallery of cooling passages, bearing areas, rocker arms, etc., while the high pressure accumulator may supply a working fluid, for instance, to actuate steering, lifting, and/or compression release braking cylinders. Such a fluid accumulator may include, for instance, a rail, a manifold, a gallery of passages, a filter system, a cooler system, a pumping system, or any other component or system that provides a volume wherein fluid may accumulate.

One application for a dual pressure fluid system may be to supply a fluid, for instance, a lube oil, at a low pressure to lubricate and cool the engine and to also supply this fluid at a high pressure to actuate, or assist in the actuation of, fuel injectors. However, prior to starting the engine, and particularly prior to cold starts, drainage in the fluid system may have allowed the standing pressures within the system to dissipate, or at least partially dissipate, and the quantity of fluid retained in the normally pressurized volumes to be reduced, for instance, by standing fluids draining back to a sump. Thus, upon start-up of the engine when the low pressure lubrication or cooling pump in the fluid pressure system is activated, there may be a delay or lag time in filling and pressurizing the inlet side of the high pressure pump or pump section. This delay may be aggravated if the fluid pumped from the lubrication or cooling pump first refills and repressurizes the low pressure fluid accumulator, for instance, a manifold and associated passages, which typically encompass a fairly large volume. This delay may be especially aggravated if some of the fluid in the low pressure portion of the system, for instance, fluid in a filter system and/or a cooling system, has drained through the other engine components, such as piston cooling jets and bearings, after the previous hot shut down. In this application, any delay in pressurizing the inlet side of the high pressure pump translates into a delay in actuating the fuel injectors and a corresponding delay in starting the engine.

U.S. Pat. No. 5,121,730 issued to Ausman et al., dated Jun. 16, 1992, discloses the use of two paths to bypass a fluid filter in a hydraulic actuating fluid circuit. The first path bypasses the fluid filter when the pressure differential between the outlet of a first pump and a priming reservoir is great enough to cause a check valve in this first path to open. The second path bypasses the fluid filter in the hydraulic actuating fluid circuit when the difference between the pressures upstream and downstream of the fluid filter (for example, when the filter is plugged with debris) causes a bypass valve to open.

There is a need in the engine industry, particularly with respect to engines using a dual pressure fluid system for, among other things, actuating fuel injectors, for a dual pressure fluid system that efficiently and quickly supplies fluid to the high pressure portion of the system upon start-up. The present invention is directed to overcoming one or more of the problems or disadvantages associated with the prior art.

SUMMARY OF THE INVENTION

In one aspect of the invention, a fluid system for supplying a low pressure fluid and a high pressure fluid is provided. The fluid system may include first and second fluid pumps, a fluid filter, low and high pressure fluid accumulators, and a priority valve. The first fluid pump is configured to discharge a first fluid pump outlet flow, which is divisible into first and second portions. The fluid filter is connected to the first fluid pump to receive the first portion of the first fluid pump outlet flow and is configured to discharge a fluid filter outlet flow, which is divisible into first and second portions. The low pressure fluid accumulator is connected to the fluid filter to receive the first portion of the fluid filter outlet flow. The priority valve is connected to the first fluid pump to receive the second portion of the first fluid pump outlet flow and to the fluid filter to receive the second portion of the fluid filter outlet flow, and is configured to discharge a priority valve outlet flow. The priority valve is movable between a first position, which provides a first priority valve fluid flow path between the second portion of the first fluid pump outlet flow and the priority valve outlet flow, and a second position, which provides a second priority valve fluid flow path between the second portion of the fluid filter outlet flow and the priority valve outlet flow. The second fluid pump is connected to the priority valve to receive the priority valve outlet flow and is configured to discharge a second fluid pump outlet flow. The high pressure fluid accumulator is connected to the second fluid pump to receive the second fluid pump outlet flow.

In another aspect of the invention, a pressure and temperature controlled valve for controlling the flow path of a fluid is provided. The valve may include a housing, a spool, a resilient element, and a thermally reactive element. The housing has a first fluid inlet port, a second fluid inlet port, and a fluid outlet port. The spool is located within the housing and is movable between a first position, at which flow of the fluid along a first flow path between the first fluid inlet port and the fluid outlet port is passed and flow of the fluid along a second flow path between the second fluid inlet port and the fluid outlet port is blocked, and a second position, at which flow of the fluid along the first flow path is blocked and flow of the fluid along the second flow path is passed. The resilient element biased the spool relative to the housing to a first position. The thermally reactive element is exposed to a temperature input, the thermally reactive element having a first configuration in response to the temperature input being at a first temperature, the first configuration allowing the spool to be in the first position, and having a second configuration in response to the temperature input being at a second temperature, the second configuration preventing the spool from being in the first position.

In a further aspect of the invention, a method for supplying a low pressure fluid and a high pressure fluid is provided.

The method may include pumping a fluid through a first fluid pump to create a first pumped flow and filtering a first portion of the first pumped flow to create a filtered flow. The method may further include passing a first portion of the filtered flow to a first inlet port of a priority valve and passing a second portion of the first pumped flow to a second inlet port of a priority valve. The method may also include transmitting one of the first portion of the filtered flow and the second portion of the first pumped flow through the priority valve to create a priority valve outlet flow, passing the priority valve outlet flow to a second fluid pump, and pumping the priority valve outlet flow through the second fluid pump to create a second pump outlet flow.

It is to be understood that both the foregoing general background, the following detailed description, and the drawings are exemplary and explanatory only and are not restrictive of the invention.

DETAILED DESCRIPTION

Figure 1:
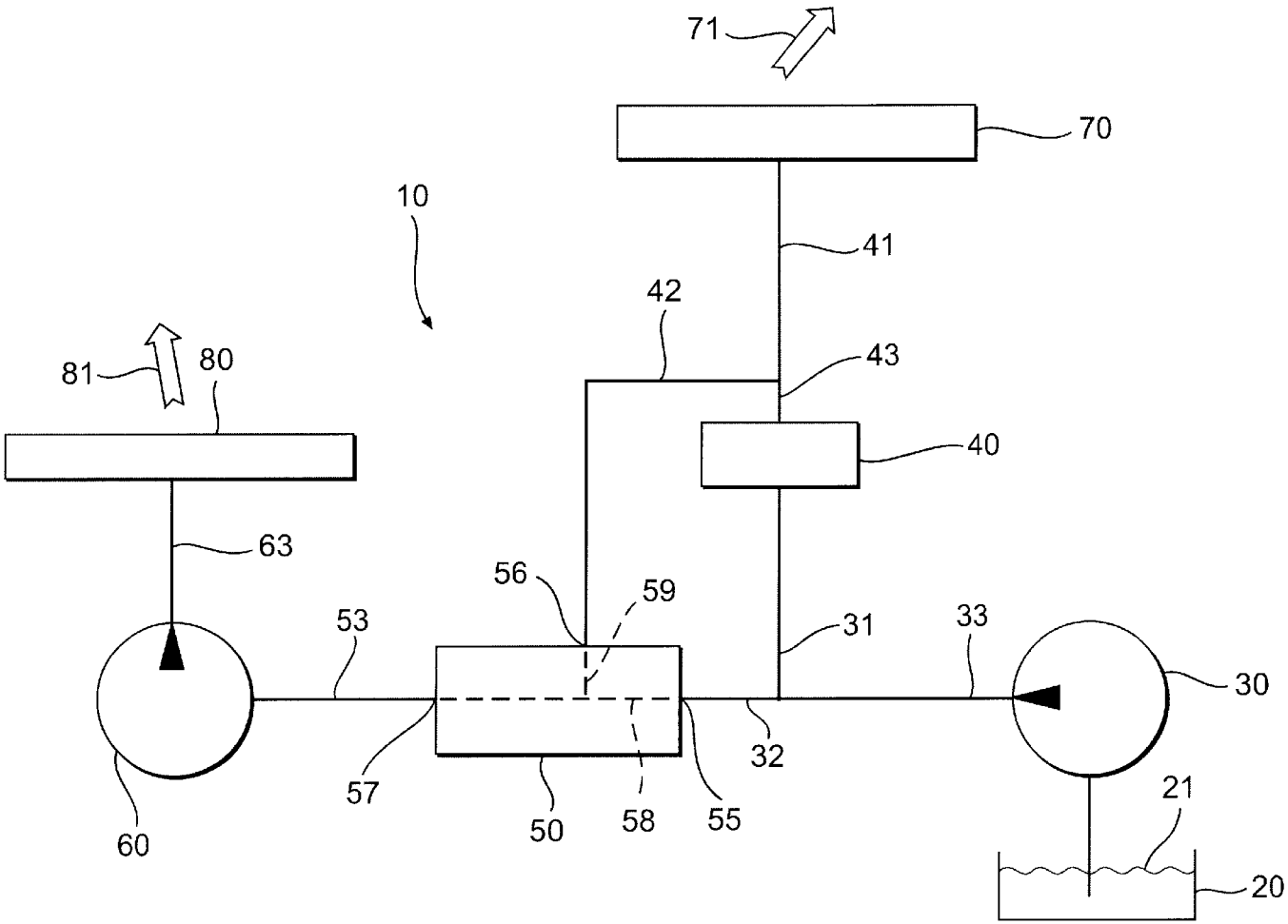
FIG. 1 is a schematic illustration of an exemplary embodiment of a fluid system in accordance with the disclosure.
Figure 2:
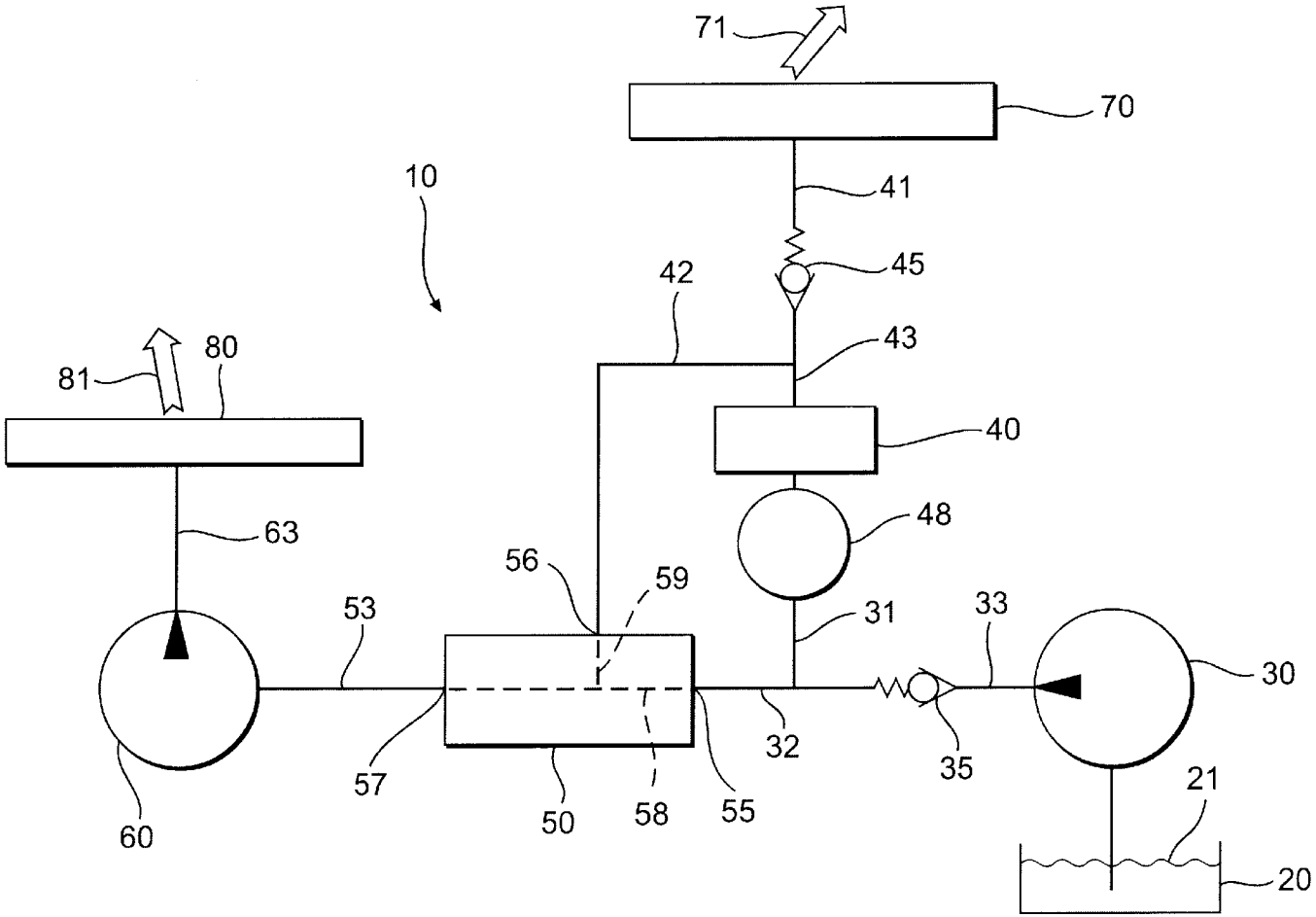
FIG. 2 is a schematic illustration of an embodiment of a fluid system in accordance with the disclosure.

Referring to FIGS. 1 and 2, a fluid system 10 for supplying a low pressure fluid and a high pressure fluid is shown. A first pump supplies low pressure fluid to a low pressure portion of the system and to a second pump. The low pressure portion may include a low pressure fluid accumulator, such as a manifold, rail, accumulator, passage, or gallery of passages, or other volume for accumulating and distributing low pressure fluid. The low pressure portion of system 10 may also include, for instance, filter and/or cooling systems. The second pump supplies high pressure fluid to a high pressure portion of system 10. The high pressure fluid may supply a high pressure fluid accumulator, such as a manifold, rail, gallery or other volume for accumulating and distributing high pressure fluid.

The phrase "low pressure" is to be understood relative to the phrase "high pressure"—low pressure refers to a pressure that is lower than a pressure referred to as high pressure. For instance, the low pressure portion of fluid system 10 of FIGS. 1 and 2 could supply a lubricating and cooling fluid to a diesel engine at a pressure of, for example, from 40 psi to 100 psi, and the high pressure portion of fluid system 10 could supply a working fluid for hydraulically actuating fuel injectors at a pressure of, for example, from 500 psi to 5000 psi.

Under normal operating conditions, the fluid supplied to the second pump is filtered. However, under certain other operating conditions, for example, during a cold start, the fluid supplied to the second pump bypasses the filter and goes directly to the second pump. A priority valve controls when the fluid supplied to the second pump bypasses the filter.

Fluid system 10 of FIG. 1 may include a fluid source 20 containing fluid 21. Fluid source 20 may be a reservoir, an oil pan, a fuel tank, a coolant overflow tank, or any other fluid source. In general, fluid 21 may be any fluid, including, for example, water, oil, hydraulic fluid, coolant, and fuel.

Fluid system 10 includes a first fluid pump 30. First fluid pump 30 may be configured to pump fluid 21 from fluid source 20 and to discharge a first fluid pump outlet flow 33. In general, first fluid pump 30 may be any suitable lubrication pump, for instance, a gear pump, piston pump and the like, as is known to persons of ordinary skill in the art. First fluid pump outlet flow 33 is discharged from first fluid pump 30 at a low pressure, as defined above.

A second exemplary embodiment of fluid system 10, as shown in FIG. 2, may further include a check valve 35. Check valve 35 may be operatively located in first fluid pump outlet flow 33. Check valve 35 may prevent siphon drain-back to first fluid pump 30 from components downstream of check valve 35 by maintaining a pressure downstream of check valve 35 that is above a pressure upstream of check valve 35. For example, check valve 35 may be a rubber-seated check valve, or any other check valve known to persons of ordinary skill in the industry, which maintains a downstream pressure that is anywhere from 0.5 psi to 5 psi above an upstream pressure. Check valve 35 may also be used to reduce pressure within a pump head volume to help purge air from first fluid pump 30 at startup. Downstream of check valve 35, first fluid pump outlet flow 33 is split into two low pressure flow paths—a first portion 31 and a second portion 32.

Fluid system 10, as shown in both FIGS. 1 and 2, includes fluid filter 40. Fluid filter 40 may be configured to receive first portion 31 of first fluid pump outlet flow 33 and to discharge a fluid filter outlet flow 43. Fluid filter 40 may be any suitable filter for removing particles or debris from the fluid flow as is known to persons of ordinary skill in the art. As shown in FIG. 2, fluid system 10 may further include a fluid heat exchanger or cooler 48, which is operatively located in first portion 31 of first fluid pump outlet flow 33. While fluid cooler 48 is shown in FIG. 2 as being located upstream of fluid filter 40, fluid cooler 48 may alternatively be located downstream of fluid filter 40. Downstream of fluid filter 40 (and fluid cooler 48, if utilized), fluid filter outlet flow 43 is split into two low pressure flow paths—a first portion 41 and a second portion 42.

Fluid system 10, as shown in both FIGS. 1 and 2, further includes a low pressure fluid accumulator 70, for instance, a low pressure fluid rail. Low pressure fluid accumulator 70 may be configured to receive first portion 41 of fluid filter outlet flow 43. Fluid in low pressure fluid accumulator 70 is collected and stored at a relatively low pressure ranging, by way of a non-limiting example, from approximately 40 psi to approximately 100 psi. Fluid in low pressure fluid accumulator 70 may be distributed, via one or more distribution paths 71, to one or more downstream components (not shown), for instance, to the many components in a engine that require lubrication and/or cooling.

As shown in FIG. 2, a back-pressure valve, such as check valve 45, may be operatively located in first portion 41 of fluid filter outlet flow 43. Check valve 45 maintains a fluid pressure upstream of valve 45 that is greater than the downstream fluid pressure. For instance, second portion 42 of fluid filter outlet flow 43 may be maintained from approximately 10 psi to approximately 20 psi above a fluid pressure in low pressure fluid accumulator 70. Any suitable back-pressure valve, as known to persons of ordinary skill in the art, may be used. The specific pressure differential will be a function of the back-pressure rating of the particular valve selected. Additionally, a remote sensor line (not shown) may connect low pressure fluid accumulator 70 to a bypass valve (not shown) associated with first fluid pump 30, so that the pressure within low pressure fluid accumulator 70 may be maintained within a desired range.

Under certain operating conditions, as will be discussed below, second portion 42 of fluid filter outlet flow 43 may be a feed to a second fluid pump 60. Thus, under certain operating conditions, check valve 45 may maintain the pressure of the fluid feed to second fluid pump 60 at a higher pressure than the pressure within low pressure fluid accumulator 70. This pressure differential performs two functions under these conditions: (1) the supply of fluid to second portion 42 of fluid filter outlet flow 43, and ultimately to second fluid pump 60, is given priority over the supply of fluid to low pressure fluid accumulator 70; and (2) even if the pressure of the fluid within low pressure fluid accumulator 70 drops, the pressure in the flow to second fluid pump 60 is maintained at the rated supply pressure.

Fluid system 10, as shown in FIGS. 1 and 2, also includes a priority valve 50. Depending upon certain operating conditions, priority valve 50 may transmit the unfiltered flow associated with second portion 32 of first fluid pump outlet flow 33 or it may transmit the filtered flow associated with second portion 42 of fluid filter outlet flow 43. Priority valve 50 receives both second portion 42 of fluid filter outlet flow 43 and second portion 32 of first fluid pump outlet flow 33. Priority valve 50 discharges a priority valve outlet flow 53. Under a first set of conditions, priority valve 50 provides a first priority valve fluid flow path 58 for flow of unfiltered fluid. Flow path 58 extends between second portion 32 and priority valve outlet flow 53. Under a second set of conditions, priority valve 50 provides a second priority valve fluid flow path 59 for flow of filtered fluid. Flow path 59 extends between second portion 42 and priority valve outlet flow 53.

Priority valve 50 may be configured such that when it provides second priority valve fluid flow path 59 for transmitting second portion 42, first priority valve fluid flow path 58 may be blocked. In this configuration, only the filtered flow of second portion 42 is directed through priority valve 50, and all of the unfiltered flow of second portion 32 is denied passage.

In one embodiment, priority valve 50 may provide flow path 58 or flow path 59 depending upon the temperature and pressure of second portion 42 of fluid filter outlet flow 43. For instance, priority valve 50 may provide first priority valve fluid flow path 58 for the unfiltered flow when the temperature of the filtered flow, i.e., the temperature of second portion 42, is less than a set, specific temperature and when the pressure of the filtered flow is less than a set, specific pressure. When the present invention is used in conjunction with an engine, the temperature of the filtered flow may be considered an indication of the operating condition of this engine. Thus, if the temperature of second portion 42 is below a set, specific temperature, it may be deduced that the engine is running cold. In which case, if the pressure of second portion 42 is below a set, specific pressure, it may further be deduced that there will be a lag time associated with fluid being pumped from source 20, through fluid filter 40, and through priority valve 50 to second fluid pump 60. Under these operating conditions, i.e., when the temperature and pressure of second portion 42 of fluid filter outlet flow 43 are below set, specific values, priority valve provides a more direct flow path to second fluid pump 60, flow path 58. Flow path 58 allows the fluid pumped from first fluid pump 30 to bypass filter 40.

On the other hand, if the temperature of second portion 42 is above a set, specific temperature or if the pressure of second portion 42 is above a set, specific pressure, it may be assumed that the engine is either hot or that sufficient filter outlet pressure is available to supply second fluid pump 60, and that normal engine operating conditions are in effect. Under normal operating conditions, it may be desirable to provide second fluid pump 60 with a filtered flow, and thus priority valve 50, under these conditions, would be configured to provide flow path 59 for the filtered flow.

Figure 3A:
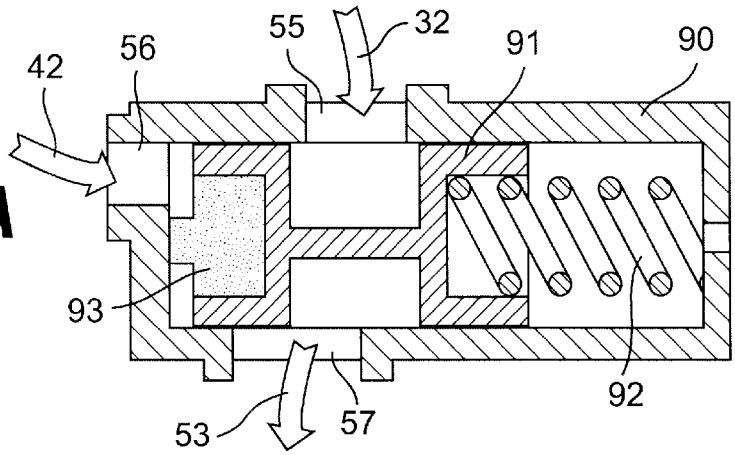
FIG. 3A is a diagrammatic cross-section of an embodiment of a priority valve in a first position.
Figure 3B:
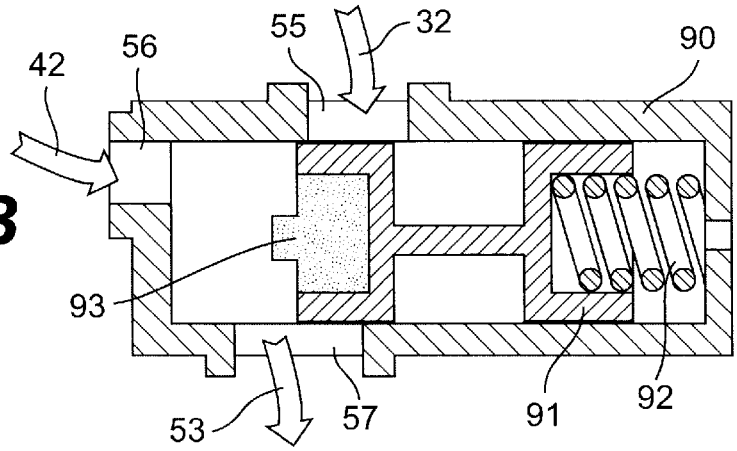
FIG. 3B is a diagrammatic cross-section of the priority valve of FIG. 3A in a second position.
Figure 3C:
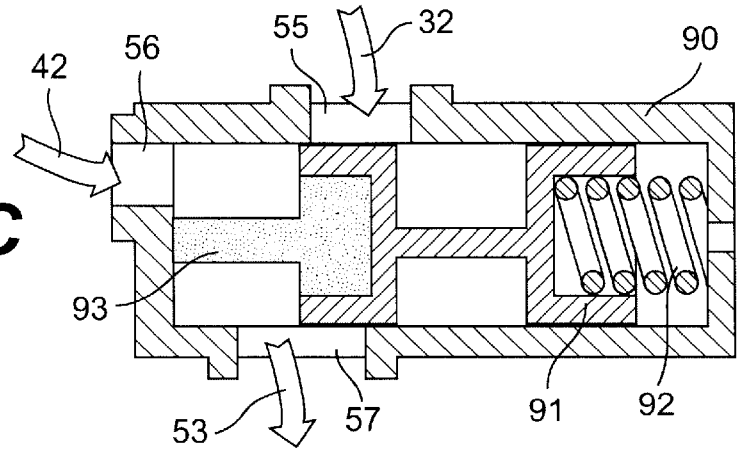
FIG. 3C is a diagrammatic cross-section of the priority valve of FIG. 3A in a third position.

In one exemplary embodiment, as shown in FIGS. 3A–3C, priority valve 50 may be a temperature and pressure controlled valve for controlling the flow path of a fluid. Priority valve 50 may include a housing 90, a spool 91, a resilient element 92 and a thermally reactive element 93.

Housing 90 includes a first fluid inlet port 55, a second fluid inlet port 56, and a fluid outlet port 57. First fluid inlet port 55 receives an unfiltered flow from second portion 32 of first fluid pump outlet flow 33. Second fluid inlet port 56 receives a filtered flow from second portion 42 of fluid filter outlet flow 43. Fluid outlet port 57 discharges a priority valve outlet flow 53. In addition to these inlet and outlet ports, housing 90 may also include, for instance, a bleed port (not shown) to source 20. Housing 90 may be made of any suitable material, including both metals and non-metals, as would be known to persons of ordinary skill in the art.

Spool 91 is located within housing 90. Spool 91 is shown with a seat at one end for retaining resilient element 92 between spool 91 and housing 90 and a seat at the opposite end for retaining thermally reactive element 93 between spool 91 and housing 90. When spool 91 is in a first position, as shown in FIG. 3A, first priority valve fluid flow path 58 extends between first fluid inlet port 55 and fluid outlet port 57 and allows the flow of unfiltered fluid associated with second portion 32 of first fluid pump outlet flow 33 to be discharged from priority valve 50 as priority valve outlet flow 53. In this first position, spool 91 blocks second priority valve fluid flow path 59. When spool 91 is in the second position, as shown in FIGS. 3B and 3C, second priority valve fluid flow path 59 extends between second fluid inlet port 56 and fluid outlet port 57 and allows the flow of filtered fluid associated with second portion 42 of fluid filter outlet flow 43 to be discharged from priority valve 50 as priority valve outlet flow 53. In this second position, spool 91 blocks first priority valve fluid flow path 58. Although spool 91 is shown in FIGS. 3A–3C as being slidably movable within housing 90 from a first position (FIG. 3A) to a second position (FIGS. 3B and 3C), spool 91 could also be rotatably or pivotable movable within housing 90.

Resilient element 92, which may also be located within housing 90, biases spool 91 relative to housing 90. As shown in FIG. 3A, resilient element 92 may bias spool 91 in the first position. The second portion 42 of fluid filter outlet flow 43 has an associated pressure as it enters housing 90 through second inlet port 56. If the pressure of this flow is great enough, the biasing force of resilient element 92 will be overcome and spool 91 may then move from the first position toward the second position, as shown in FIGS. 3B and 3C. Resilient element 92 is schematically depicted as a helical compression spring, but any resilient, elastically deformable element, including tension springs, torsion springs, foam or rubber gaskets, as known to ordinary persons of skill in the art may be used to bias spool 91 within housing 90.

Thermally reactive element 93 may also be located within housing 90. Furthermore, thermally reactive element 93 may be exposed to the filtered fluid flow associated with second portion 42, and thus, thermally reactive element 93 may be exposed to the temperature of this filtered fluid flow, i.e., the temperature of the fluid flowing along flow path 59. Thermally reactive element 93 may have a first configuration, as shown in FIG. 3A and as shown in FIG. 3B, when this temperature of the filtered fluid flow is less than a set, specific temperature. With thermally reactive element 93 in this first configuration, spool 91 may be positioned within housing 90 at the first position, as shown in FIG. 3A, at the second position, as shown in FIG. 3B, or at some in between position. In addition, thermally reactive element 93 may have a second configuration, as shown in FIG. 3C, when the temperature of the filtered fluid flow is equal to or greater than a set, specific temperature. When exposed to a temperature above the set, specific temperature, thermally reactive element 93 may expand, or elongate, or cause a spool to extend, or in some manner extend beyond the confines of at least one of its boundaries in its first configuration. When thermally reactive element 93 assumes this second configuration, spool 91 may then be prevented from being located in the first position within housing 90.

Thermally reactive element 93 may be, for instance, a wax thermostat, an element formed from a shape memory material, or any other suitable element known to persons of ordinary skill in the art. Alternatively, thermally reactive element 93 may include a remote temperature sensor (not shown) and an actuator (not shown). For instance, the remote temperature sensor may be thermally coupled to a remote portion of the engine or to any other component that is indicative of the temperature of the engine. This remote temperature sensor may transmit a signal to the actuator when the sensed temperature exceeds a set, predetermined temperature. This signal may activate the actuator such that second priority valve fluid flow path 59 is maintained as long as this set, predetermined temperature is exceeded.

Referring now back to FIGS. 1 and 2, fluid system 10 includes a second fluid pump 60 configured to receive priority valve outlet flow 53 and to discharge a second fluid pump outlet flow 63. Depending upon the specific application, second fluid pump 60 may be a high efficiency pump, such as a variable, axial sleeve-metered, fixed-displacement pump, which may, for instance, be capable of increasing the pressure in the fluid a hundred fold. Alternatively, second fluid pump 60, may be a less efficient, less capable pump, or any other suitable pump known to persons of ordinary skill in the art. Second fluid pump 60 should be capable of pumping both filtered and unfiltered flows.

In alternative embodiments, priority valve 50 and second fluid pump 60 may form a subassembly, first hydraulic pump 30 and priority valve 50 may form a subassembly, or all three components may form a single subassembly.

Fluid system 10 may further include a high pressure fluid accumulator 80, such as a high pressure fluid rail, configured to receive second fluid pump outlet flow 63. High pressure fluid accumulator 80 may collect and store fluid at a relatively high pressure, ranging, by way of a non-limiting example, from approximately 500 psi to approximately 5000 psi. Fluid in high pressure fluid accumulator 80 may be distributed, via one or more distribution paths 81, to one or more downstream components (not shown), for instance, to actuate steering, lifting, or compression release braking cylinders or to actuate fuel injectors for diesel engines.

INDUSTRIAL APPLICABILITY

The fluid system 10 of FIGS. 1 and 2 may be adapted for use with engines, such as, for example, a diesel engine. One exemplary use of the fluid system 10 of FIG. 2 could be with a diesel engine having high efficiency fuel injectors. The engine itself requires a low pressure oil, anywhere from 40 psi to 100 psi, for lubricating and cooling the engine and its components, while the fuel injectors require a high pressure oil, anywhere from 500 psi to 5000 psi for actuating the injectors.

A source 20, such as the oil pan of the diesel engine, holds a supply of a fluid 21, such as lube oil. A first pump 30, such as a main lube pump, supplies the oil at a relatively low pressure to a low pressure oil rail or accumulator 70. This main lube pump 30 also supplies the low pressure oil to a second pump 60, such as a high pressure, high efficiency, fixed displacement pump. High pressure pump 60 in turn supplies oil at a relatively high pressure to a high pressure oil rail or accumulator 80. When the engine is running under normal hot conditions, the oil supplied to high pressure pump 60 is passed through oil cooler 48 and oil filter 40. However, under certain operating conditions, such as during a cold start, the oil supplied to high pressure pump 60 bypasses cooler 48 and filter 40 and goes directly to high pressure pump 60. Priority valve 50 controls when the oil supplied to high pressure pump 60 bypasses cooler 48 and filter 40.

During a cold start, the oil in fluid system 10 has a relatively high viscosity, because the oil is cold and sluggish. Moreover, the oil pressures in the system are typically below operating pressures, because some portion of the oil has drained to the supply reservoir since the engine was last shut down or, possibly, because of leaks in the system. Under these relatively low temperature and low pressure operating conditions, if the cold oil from source 20 was pumped through cooler 48 and filter 40 to high pressure pump 60 to be further pressurized and then pumped into accumulator 80, there could be a significant delay in developing the high oil pressure in accumulator 80 that is necessary to actuate the fuel injectors and to actually start the engine.

In the embodiment shown in FIGS. 3A, spool 91 of priority valve 50 is biased by resilient element 92 in a position that allows the cold oil from source 20 to be pumped directly to high pressure pump 60, without having to travel through cooler 48 or filter 40. This unfiltered oil flow 32 through priority valve 50 to high pressure pump 60 quickly pressurizes accumulator 80 to its operating pressure, thus quickly and efficiently allowing the fuel injectors to actuate and start the engine.

Once the oil in the low pressure portion of fluid system 10 reaches its operating pressures, the flow of oil to high pressure pump 60 can be effectively supplied with oil passing through filter 40. Using filtered oil is preferred to using unfiltered oil. At normal operating pressures, the pressure in filtered flow 42, as it enters priority valve 50, is high enough to push spool 91 back against the biasing force of resilient element 92, as shown in FIG. 3B. Spool 91 is then positioned such that unfiltered oil flow 32 is blocked and filtered oil flow 42 passes through priority valve 50 to reach high pressure pump 60.

In addition, once the filtered oil flow 42 reaches its normal operating temperature within priority valve 50, thermally reactive element 93, such as a wax thermostat bulb, expands or changes configuration as shown in FIG. 3C. This configuration, which thermally reactive element 93 assumes at normal operating temperatures, prohibits the return of spool 91 to its cold start position even if the pressure in filtered oil flow 42 falls below its normal operating pressure and is thereby no longer able to overcome the biasing force of resilient element 92. Thus, once the engine is in a hot running condition and filtered oil flow 42 reaches its normal operating temperature, spool 91 allows filtered oil flow 42 to pass through priority valve 50, even if the pressure in filtered oil flow 42 decreases. These conditions might occur, for instance, during a hot start of the engine or during hot-engine, low-idle speed operations.

It will be readily apparent to those skilled in this art that various changes and modifications of an obvious nature may be made to the disclosed invention, and all such changes and modifications are considered to fall within the scope of the appended claims. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A fluid system for supplying a low pressure fluid and a high pressure fluid, the fluid system comprising:

a first fluid pump configured to discharge a first fluid pump outlet flow, which is divisible into a first and a second portion;

a fluid filter connected to said first fluid pump to receive said first portion of said first fluid pump outlet flow and configured to discharge a fluid filter outlet flow, which is divisible into a first and a second portion;

a low pressure fluid accumulator connected to said fluid filter to receive said first portion of said fluid filter outlet flow;

a priority valve connected to said first fluid pump to receive said second portion of said first fluid pump outlet flow, connected to said fluid filter to receive said second portion of said fluid filter outlet flow, and configured to discharge a priority valve outlet flow, said priority valve movable between a first position, which provides a first priority valve fluid flow path between said second portion of said first fluid pump outlet flow and said priority valve outlet flow, and a second position, which provides a second priority valve fluid flow path between said second portion of said fluid filter outlet flow and said priority valve outlet flow;

a second fluid pump connected to said priority valve to receive said priority valve outlet flow and configured to discharge a second fluid pump outlet flow; and a high pressure fluid accumulator connected to said second fluid pump to receive said second fluid pump outlet flow.

2. The fluid system of claim 1, wherein said low pressure fluid accumulator supplies fluid to lubricate a diesel engine and said high pressure fluid accumulator supplies fluid to fluidly actuate fuel injectors.

3. The fluid system of claim 2, further including a fluid cooler to receive said first portion of said first fluid pump outlet flow.

4. The fluid system of claim 2, further including a check valve disposed in said first portion of said fluid filter outlet flow.

5. The fluid system of claim 4, wherein said check valve is configured to maintain a pressure in said second portion of said fluid filter outlet flow from approximately ten pounds-per-square-inch to approximately twenty pounds-per-square-inch above a pressure in said low pressure fluid accumulator.

6. The fluid system of claim 2, further including a check valve disposed in said first fluid pump outlet flow.

7. The fluid system of claim 6, wherein said check valve maintains a pressure downstream of said check valve that is approximately one pound-per-square-inch to approximately 5 pounds-per-square-inch above a pressure upstream of said check valve.

8. The fluid system of claim 1, wherein said priority valve is in said first position and said second priority valve fluid flow path is blocked.

9. The fluid system of claim 1, wherein said second portion of said fluid filter outlet flow has a temperature and a pressure, and said priority valve provides said first priority valve fluid flow path in response to the temperature being less than a predetermined temperature and the pressure being less than a predetermined pressure.

10. The fluid system of claim 9, wherein said priority valve provides said second priority valve fluid flow path in response to the temperature being equal to or greater than said predetermined temperature or the pressure being equal to or greater than said predetermined pressure.

11. The fluid system of claim 1, wherein said priority valve includes a housing having a first fluid inlet port, a second fluid inlet port, and a fluid outlet port, a spool located within said housing, a resilient element biasing said spool relative to said housing to a first position, and a thermally reactive element exposed to a temperature input.

12. The fluid system of claim 11, wherein said spool, in a first position, provides said first priority valve fluid flow path from said first fluid inlet port to said fluid outlet port and substantially blocks said second priority valve fluid flow path, and, in a second position, provides said second priority valve fluid flow path from said second fluid inlet port to said fluid outlet port and substantially blocks said first priority valve fluid flow path.

13. The fluid system of claim 11, wherein said thermally reactive element has a first configuration in response to said temperature input being less than a predetermined temperature, said first configuration allowing said spool to be in said first position, and said thermally reactive element has a second configuration in response to said temperature input being equal to or greater than said predetermined temperature, said second configuration of said thermally reactive element preventing said spool from being in said first position.

14. A pressure and temperature controlled valve for controlling the flow path of a fluid, the valve comprising:

a housing having a first fluid inlet port, a second fluid inlet port, and a fluid outlet port;

a spool located within said housing, said spool movable between a first position, at which flow of the fluid along a first flow path between said first fluid inlet port and said fluid outlet port is passed and flow of the fluid along a second flow path between said second fluid inlet port and said fluid outlet port is blocked, and a second position, at which flow of the fluid along said first flow path is blocked and flow of the fluid along said second flow path is passed;

a resilient element biasing said spool relative to said housing to a first position; and a thermally reactive element exposed to a temperature input, said thermally reactive element having a first configuration in response to said temperature input being at a first temperature, said first configuration allowing said spool to be in said first position, and having a second configuration in response to said temperature input being at a second temperature, said second configuration preventing said spool from being in said first position.

15. The valve of claim 14, wherein said thermally reactive element is a wax thermostat.

16. The valve of claim 14, wherein said temperature input is a temperature of the fluid flowing along said second flow path.

17. The valve of claim 14, wherein said spool moves from said first position to said second position in response to a pressure of the fluid flowing along said second flow path.

18. A method for supplying a low pressure fluid and a high pressure fluid, the method comprising:

pumping a fluid through a first fluid pump to create a first pumped flow;

filtering a first portion of said first pumped flow to create a filtered flow;

passing a first portion of said filtered flow to a first inlet port of a priority valve;

passing a second portion of said first pumped flow to a second inlet port of a priority valve;

transmitting one of said first portion of said filtered flow and said second portion of said first pumped flow through said priority valve to create a priority valve outlet flow;

passing said priority valve outlet flow to a second fluid pump; and pumping said priority valve outlet flow through said second fluid pump to create a second pump outlet flow.

19. The method of claim 18, wherein said first portion of said filtered flow at said first inlet port has a pressure and a temperature and said second portion of said first pumped flow is transmitted through said priority valve in response to the temperature being less than a predetermined temperature and the pressure being less than a predetermined pressure.

20. The method of claim 18, wherein said first portion of said filtered flow at said first inlet port has a pressure and a temperature and said first portion of said first pumped flow is transmitted through said priority valve in response to the temperature being more than a predetermined temperature or the pressure being more than a predetermined pressure.

21. The method of claim 18, further including:

providing a second portion of said filtered flow to a low pressure fluid accumulator wherein said low pressure fluid accumulator supplies lubricating oil to a diesel engine; and providing said second fluid pump outlet flow to a high pressure fluid accumulator wherein said high pressure fluid accumulator supplies an oil to fluidly actuate fuel injectors.

* * * * *